United States Patent [19]

Warner et al.

[11] 4,345,538

[45] Aug. 24, 1982

[54] FLAP FLEXURE RETAINER/SEAL FOR HYDROFOIL VESSELS AND THE LIKE

[75] Inventors: Gary J. Warner, Issaguah; Winfried M. Feifel, Redmond, both of Wash.

[73] Assignee: The Boeing Company, Seattle, Wash.

[21] Appl. No.: 174,268

[22] Filed: Jul. 31, 1980

[51] Int. Cl.[3] ..... B63B 1/24; B63B 1/26

[52] U.S. Cl. ..... 114/274; 114/280; 244/215

[58] Field of Search ..... 403/372, 381, 361; 244/90 R, 131, 130, 213, 219; 114/274, 280, 281

[56] References Cited

U.S. PATENT DOCUMENTS

| | | | |
|---|---|---|---|
| 2,329,133 | 9/1943 | Peed | 244/215 |
| 3,070,392 | 12/1962 | Potter | 403/361 |
| 3,968,946 | 7/1976 | Cole | 244/130 |
| 4,213,587 | 7/1980 | Roeseler | 244/215 |

*Primary Examiner*—Trygve M. Blix
*Assistant Examiner*—D. W. Keen
*Attorney, Agent, or Firm*—Delbert J. Barnard; Eugene O. Heberer; Joan H. Pauly

[57] ABSTRACT

A combined, liner retainer and seal for use with hydrofoils in which fluid foils have trailing control flaps, keyed together. The control flaps are hingedly engaged to the trailing end of the foils and are rotated on the hinge for control purposes. The flaps are segmented to form a series and in each pair a key extends from a driving flap into a keyway in a driven flap so that the flaps are rotatable together. There is an elastic liner within the keyways and into which the key fits, the liner serving to protect the metallic surfaces of the keys and keyways. The combined seal and retainer extends between the flaps from the trailing end of the foil to the trailing edge of the flaps and has openings through which a hinge pin and the key extends. The retainer is elastic and holds the liner within the keyway so as to prevent its dislodgment and destruction. Spaces between the flaps permit pressure blend therethrough and because there are a considerable number of driver to driven flap interfaces, the negative effects of resulting cavitation flow are cumulative. The seal substantially inhibits the pressure bleed between the flaps so as to greatly reduce cavitating and/or separating flow. In another embodiment the retainer/seal and liner are combined into one part.

20 Claims, 12 Drawing Figures

FLAP FLEXURE RETAINER/SEAL FOR HYDROFOIL VESSELS AND THE LIKE

BACKGROUND OF THE INVENTION

The present invention relates in general to segmented, control flaps or rudder devices on various commercial and military marine craft, aircraft, missiles, and spacecraft. In hydrofoils, for example, leading fluid foils have multiple control flaps, hingedly engaged at their leading edges to foil trailing ends for rotation with respect to the foil for control purposes. Generally, two flaps centrally positioned with respect to the span are driven by hinge means. In each pair of flaps extending spanwise therefrom, the inner flap is a driver and the outer is a driven flap. The driver has a key extending into a keyway in the driven flap so that when the driver is rotated on the hinge, the driven is simultaneously rotated. In order to provide a snug fit of the key in the keyway and to protect the metal surfaces of the key and the keyway, an elastic liner is positioned in the keyway and is of a configuration to snugly receive the key and a hinge pin.

In the prior art the liners have typically been destroyed, usually piece by piece, and have become separated from the flap assembly. This has resulted in metal-on-metal structural damage to the flaps. Such damage has required costly repair and replacements. In addition there has been early fatigue failure, coupled with loss of flight control.

Hydrofoils employing segmented trailing edge flaps produce a cavitating flow at the end-to-end junction of the flaps. Because there are a multiple number of these flap-to-flap interfaces, the negative effects of the cavitating flow on performance are cumulative. For example, there may be 20 flaps, accompanied by 14 of such end-to-end junctures. Pressure bleed through the gaps between the flaps causes increased drag and also reduces the flap effectivity, which has adverse effects on ship flight controls, particularly in high sea states.

SUMMARY OF THE INVENTION

Accordingly, it is an object of the present invention to provide an improved flap flexure liner retainer and seal. As a retainer, the invention is positioned to positively retain the liner, fitted in the keyway, by lying against the peripheral edge thereof in the gap between the segmented flaps. This arrangement prevents flexure of the driver flap key from dislodging portions of the liner in the keyway in the driven flap.

Another important object of the invention is to provide a liner retainer/seal that is self-aligning within the gap between two flaps. It is self-aligning in that it seats itself on the flap key and hinge pin so as not to require fastening means other than the inherent structure.

It is still another object of the invention to provide a retainer/seal in the form of highly elastic non-metallic material so as to protect the metal structural surfaces of the flaps during flexing action in flight. The retainer's high elastomeric properties allow it to flex with flap deflection without damage to itself or to the flaps.

It is a further object of the invention to provide a seal in the hiatus between the segmented flaps so as to substantially eliminate pressure bleed between the flaps and thereby greatly reduce cavitating flow in the area adjacent the upper surfaces of the flaps. This substantially eliminates drag and improves flap effectivity. It also improves the ship flight control.

Still another important objective of the invention is to provide vital structural flap retention and protection, and improvement of performance with respect to drag and flap effectivity, and yet be very simple and inexpensive. This invention lends itself to shop maintainability in its ease of installment and/or replacement without the need of fasteners or special tools. Its low production cost results from the inherent simplicity of being fabricated from a non-metallic sheet, nylon for example.

In a second embodiment it is an object of the invention to provide an improved retainer/seal and liner in one part.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENT

Figure 1:
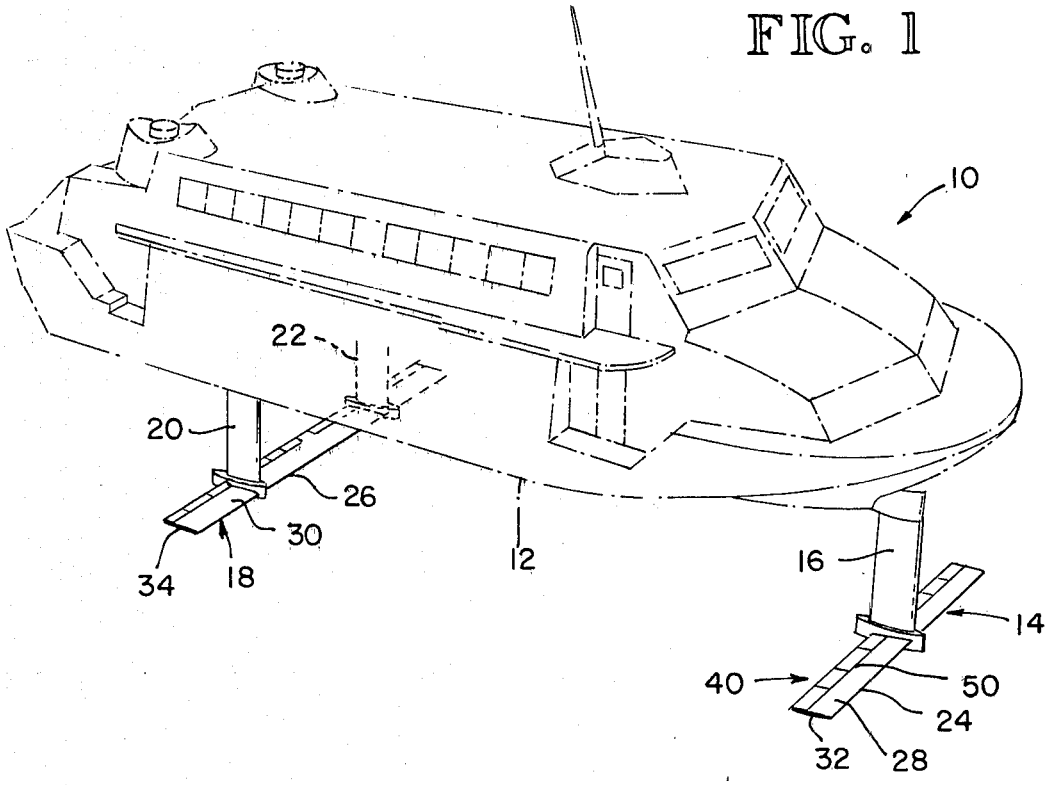
FIG. 1 is a highly diagramatic, perspective view of a typical conventional hydrofoil ship which is here illustrated as including a pair of hydrofoils, one being mounted on a central support pillar below the bow of the vessel and a second being mounted on two vertical pillars beneath the stern of the vessel.

Referring again to the drawings, there is shown in FIG. 1 in phantom outline an exemplary conventional hydrofoil vessel, generally designated as 10, the vessel having a hull 12, a forward hydrofoil 14 connected to the hull by a pillar 16, and a stern hydrofoil 18 connected to the hull by two pillars 20 and 22.

The hydro- or fluid foils 14 and 18 are shown in greater detail in FIGS. 2–4, 8, and 11. Foils 14 and 18 have generally convex leading edges 24 and 26, respectively, and have slightly convex upper surfaces 28 and 30 and similar lower surfaces 32 and 34, respectively. The foils have a trailing concave surface as 36, FIGS. 4, 8, and 11, except as at 38, FIG. 3, where the foil surface is not interrupted.

Figure 2:
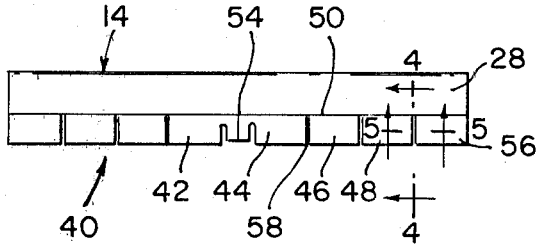
FIG. 2 is a plan view of the bow-mounted fluid foil shown in FIG. 1.
Figure 3:
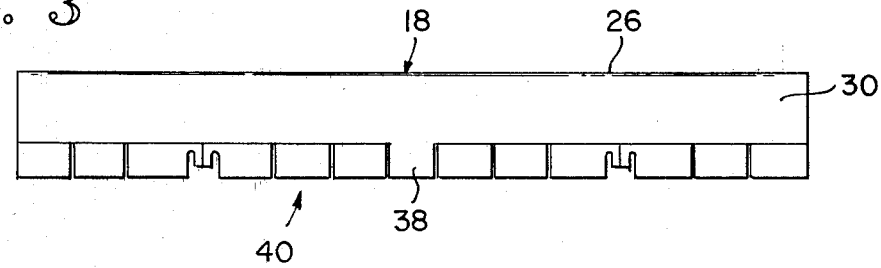
FIG. 3 is a plan view of the stern-mounted foil shown in FIG. 1.
Figure 4:
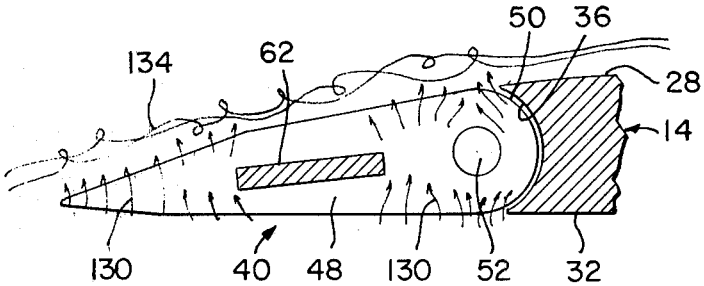
FIG. 4 PRIOR ART
FIG. 4 is a partially cross-sectional view of a driver flap taken in the hiatus between the driver and the driven flaps, substantially along the line 4—4 in FIG. 2, illustrating the pressure bleed between the flaps and the resulting cavitating flow as produced in the prior art.

As shown in FIGS. 1–4, control flaps, generally designated as 40, are hingedly engaged to the foils adjacent the trailing surface 36 so as to be rotatable to be raised or lowered to apply lift or lowering deflection, respectively, to the vessel. For purposes of the invention, the segmented flaps in FIG. 3 are the same as those in FIG. 2 and only the latter will be specifically described. The flaps in the prior art are the same as the flaps in the invention.

Relative to operation, there are two types of flaps, one type being 42 and 44 and the other being 46 and 48. All of the flaps are hingedly engaged adjacent their leading convex surface 50 on axially aligned hinge pins, as 52, so as to rotate on the same axis with respect to the foil.

The flaps 42 and 44 have their inner ends spanwise, as 54, positioned under the pillar 16 and are operated by a mechanism, not shown, extending downwardly through the pillar. The mechanism functions to raise and lower the flaps 42 and 44 independently. Whereas the flaps 42 and 44 are operated from the vessel, the flap, as 44, 46, and 48, having an adjacent flap, spanwise outwardly thereof is a driving flap and the flap outwardly thereof is a driven flap, as 46, 48, and 56. As shown in FIG. 2, the flap 44 is keyed at 58 to drive the flap 46, the flap 46 is keyed at 60 to drive the flap 48, and the flap 48 is keyed at 62 to drive the flap 56, a non-driver.

Figure 8:
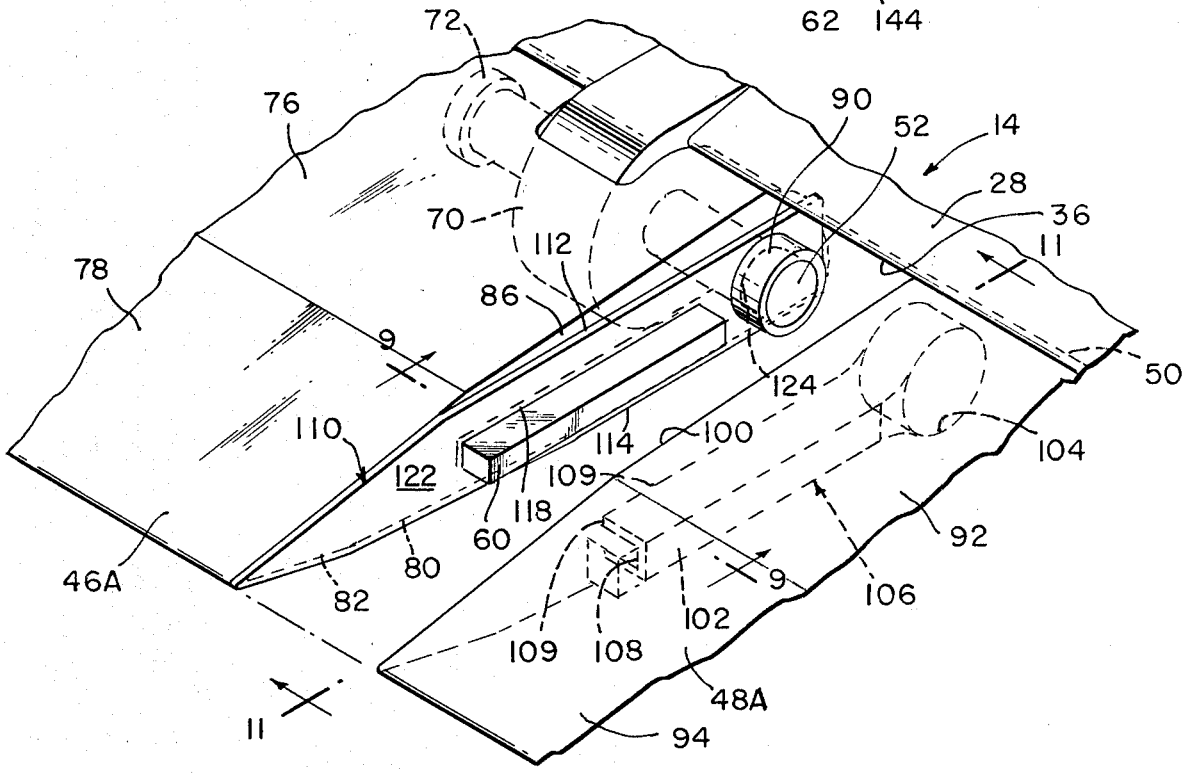
FIG. 8 is a perspective fragmentary and partially exploded view illustrating the invention.

The flaps as 46A and 48A, normally spaced for keying, are shown fragmentarily in an exploded view in FIG. 8. The flaps 46 and 48, and surrounding structures, as shown in FIG. 2, are the same as 46A and 48A, respectively, to the extent that the former are shown. That is, flaps 46A and 48A have the appearance of the prior art but include the inventive combination to be described.

The flap 46A is shown on its driving side and flap 48A is shown on its driven side. On the driving side, each flap is mounted on a pin 52 by which the flap is hingedly engaged to the trailing end of the foil 14. The pin 52 is mounted in a bearing shown at 70 in the foil and the other end 72 of the pin is secured for rotation in means, not shown, within the flap.

The flap 46A, FIGS. 8–11, has upper tapering faces 76 and 78 and lower faces 80 and 82, the faces 78 and 82 terminating in a trailing edge 84.

The pins 52 extend through a transverse vertical face, as 86, and have a bushing, as 90, thereon, spaced outwardly from the transverse face 86. Also extending outwardly from the transverse face 86 is the rectangular driving key 60, elongated in the direction toward the trailing edge. The driven flaps, as 48A, have the same upper and lower face configuration, designated as 92, 94, and 96, for example.

Figure 9:
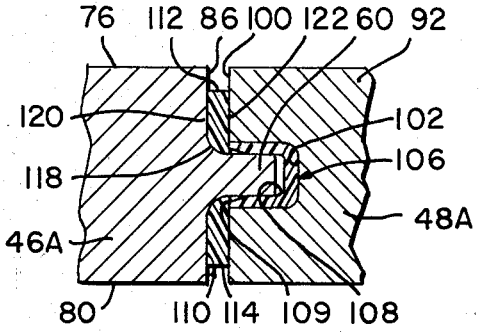
FIG. 9 is a fragmentary cross-sectional view, similar to FIG. 5 but including the invention, and taken substantially along the line 9—9 in FIG. 8.
Figure 10:
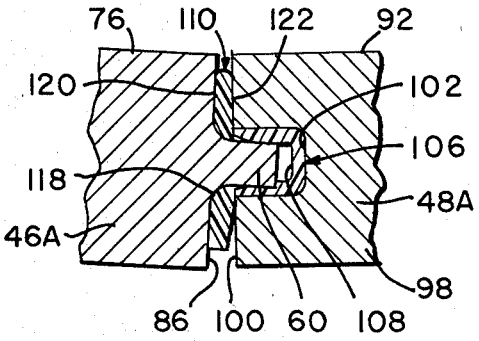
FIG. 10 is a view similar to that in FIG. 9 illustrating the invention in operation.
Figure 11:
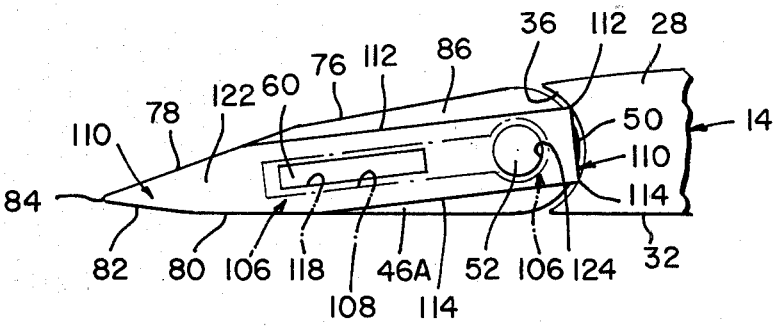
FIG. 11 is a fragmentary end view of a driver flap, illustrating the self-aligning feature of the invention, taken substantially along the line 11—11 in FIG. 8.

Opposing the transverse face 86 is a parallel transverse face 100, FIG. 9, on the driven flap 48A. It has the same peripheral configuration as the face 86 and has an elongated recess therein, channel-shaped, as at 102 opposite the key 60. It is enlarged toward the foil 14 into a generally cylindrical portion 104, having a configuration to receive the bushing 90 and pin 52. Fitted in the recess is an elastomeric liner, generally designated 106. It has a channel-shaped portion 108 to receive the key 60 in a relatively snug fit. The recess 102 extends beyond the liner 106 toward the trailing edge. The liner 106 is enlarged toward the leading edge to fit in the generally cylindrical portion 104 of the recess so to snugly receive the bushing 90 and the pin 52. The liner has an outer peripheral edge 109, exposed and flush for its full length and width with surface 100.

The improved combination, shown in FIGS. 8–11, includes the flap flexure retainer/seal, generally designated as 110. The retainer/seal is an elastic sheet, nylon for example, having a peripheral configuration congruent with the trailing edge portion of the transverse face 86 and narrowing to have two parallel edges 112 and 114 terminating in contact with concave face 36 of the foil. The retainer 110 has a rectangular cutaway portion 118, extending between its parallel faces 120 and 122, and sized to snugly fit over the key 60. There is a second cutaway portion 124 of circular shape to fit over the pin 52 under the bushing 90. This permits the retainer/seal 110 to lie against the outer peripheral edge 109 of the liner 106 and positively retain it in the recess 102. The faces 120 and 122 form a seal between the faces 86 and 100 of the driver and driven flaps and the edges 112 and 114 form a transverse seal at foil surface 36.

To understand the benefits of the present invention, it is helpful to first consider the prior art as shown in FIGS. 4–7. The flaps 48 and 56 as employed in prior art hydrofoils are spaced as at 128. This spacing permits a pressure bleed between the flaps as indicated by the arrows 130 in FIG. 4. Because there are a multiple number of such flap interfaces, indicated in FIGS. 2 and 3, the negative effects of the pressure bleeding is cumulative so as to cause a cavitating and/or separating flow as indicated by the lines 134. This causes increased drag on the hydrofoils and also reduces the flap effectivity which has adverse effects on ship flight control, particularly in high sea states.

Figure 5:
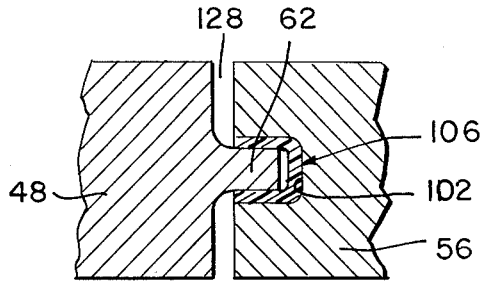
FIG. 5 PRIOR ART
FIG. 5 is a fragmentary cross-sectional view, taken along the line 5—5 in FIG. 2, and illustrating the prior art connection between the driver and driven flaps and the liner fitted on the key and in the keyway.
Figure 6:
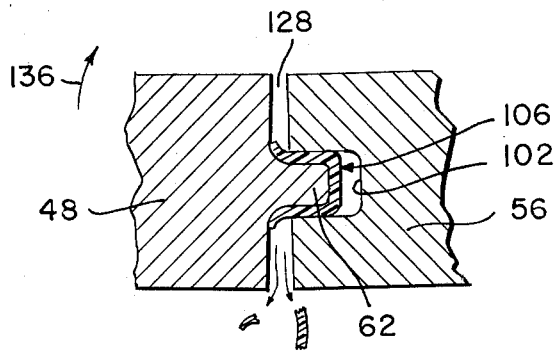
FIG. 6 PRIOR ART
FIG. 6 is a view similar to that in FIG. 5, illustrating the destruction of the liner in accordance with the prior art.
Figure 7:
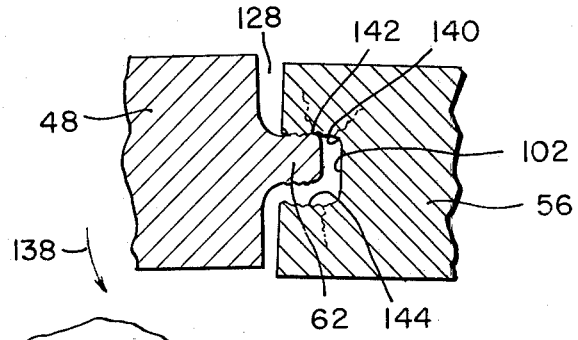
FIG. 7 PRIOR ART
FIG. 7 is a view similar to that in FIG. 6, illustrating damage as it occurred in the prior art after the liner had been destroyed and removed.

As indicated in FIGS. 5–7, liners 106 in the prior art without a retainer failed in operation. Although the liners were secured in the recesses 102 by means of a sealant, operational flexing of the flaps, as indicated by the arrows 136 and 138, FIGS. 6 and 7, caused the liners to disintegrate out of the recess and away from the key 62. The destruction and loss of the liners caused serious structural damage as, indicated at 140, 142, 144 in FIG. 7, the metal-to-metal contact causing the flaps to crack and break. This damage resulted in costly repairs and replacement of flaps, and in addition made possible the danger of loss of flight control before the damage could be discovered and repaired. The retainer 110, FIGS. 8–11, eliminates the foregoing problems.

The retainer has the additional advantage of being self-aligning with respect to the peripheral edge of the liner, as well as forming the seal in the space 100 between the two transverse faces of the driving and driven flaps. The self-aligning occurs by the retainer seating itself on the key 60 and the pin 52. This eliminates a need for fastening the retainer/seal in place.

Figure 12:
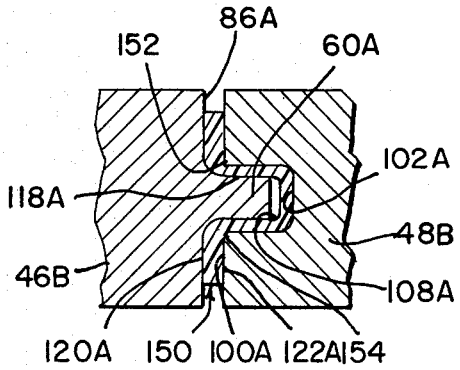
FIG. 12 is a fragmentary cross-sectional view illustrating another embodiment of the invention.

In FIG. 12 another embodiment of the invention is shown. Here, a retainer/seal and liner, generally designated as 150, is formed in one piece. A driving flap 46B and a driven flap 48B can be identical to the arrangement of the flaps 46A and 48A, in FIGS. 8–11, with some slight differences. For example, it may be beneficial to have rounded, non-cutting corners at 152 and 154. In addition, the bushing 90 need not be significantly spaced from a surface 86A as it is from the surface 86 in FIG. 8. As can be visualized from FIG. 8, the member 150 could be made by forming a sheet of plastic over the surface 86 of the flap 46A, over the key 60, and over the bushing and end of the pin 52. The corners at 112 and 114 against the surface 36, FIG. 11, would be the same.

Thus, in FIG. 12, the key 60A, the recess 102A, the enlarged cylindrical recessed portion, not shown, and the transverse surfaces 86A and 100A are the same as corresponding parts 60, 102, 104, 86, and 100, FIGS. 8–11, respectively.

The differences are only where the seal 110 would join the liner 106, at the key and keyway, and the bushing and cylindrical portion 104. Here, a channel-shaped portion 108A, as 108, is joined to a wall formed between the surfaces 120A and 122A, as 120 and 122, leaving an opening 118A, as 118. Similarly, but not shown, the liner part that fits into portion 104 in FIG. 8 would be joined to the wall formed between the surfaces 120A and 122A.

The seal/liner 150 would be self-aligned in place in the same manner as the retainer/seal 110 on the key and on the bushing 90 or in the recess. The member 150 would, thus, function in the same manner as the members 110 and 106.

Because the retainer/seal 110 and the seal/liner 150 are highly elastic, non-metallic material, they protect the metal structural surfaces of the flaps during the flexing action that normally occurs during flight. Their elastomeric properties allow them to flex with flap deflection without damage to their structure or to the flaps. By forming a seal between the flaps, they substantially inhibit all pressure bleed therebetween.

The invention and its attendant advantages will be understood from the foregoing description and it will be apparent that various changes may be made in the form, construction, and arrangements of the parts of the invention without departing from the spirit and scope thereof or sacrificing its material advantages, the arrangements hereinbefore described being merely by way of example. We do not wish to be restricted to the specific forms shown or uses mentioned except as defined in the accompanying claims.

What is claimed is:

1. In a fluid foil having a plurality of trailing control flaps, or the like, hingedly engaged to the foil for rotation with respect thereto, at least one of said flaps being a driving flap and at least one of said flaps being a driven flap, a key extending from said driving flap into a keyway in said driven flap so that said flaps rotate together with respect to said foil, an elastic liner being fitted into said keyway and being fitted on said key to protect surfaces of the key and keyway, the improvement comprising:

retainer means between said driving and driven flaps in association with said key and keyway to secure said liner in said association with said key and keyway.

2. The invention according to claim 1 in which:

said retainer means forms a seal between said driving and driven flaps, said seal extending from a foil trailing surface to adjacent the trailing edge of said flaps.

3. The invention according to claim 1 in which said liner extends outwardly to and along the periphery of the keyway opening so as to contact said retainer means.

4. The invention according to claim 3 in which:

said driving flap has a face transverse to said key and in contact with said retainer means;

said retainer means having an opening through which said key extends;

said driven flap having a face transverse to said keyway and opposing said transverse face of said driving flap;

an outer peripheral edge of said liner extending along the transverse face of said driven flap;

said retainer means being in substantial sealing contact with said opposing transverse faces on said flaps and on said peripheral edge of said liner.

5. The invention according to claim 4 in which:

said foil has a trailing concave surface adjacent which leading surfaces of said flaps are adapted to rotate;

said retainer means making contact with said concave surface to form a seal thereon in the directions of said transverse faces.

6. The invention according to claim 5 including:

a hinge pin extending through openings in said opposing transverse faces in the general direction of said key; and said retainer means having an opening through which said hinge pin extends.

7. The invention according to claim 6 in which:

said retainer means is self-aligning between said transverse faces on said key, and said hinge pin.

8. The invention according to claim 7 in which:

said retainer means is an elastic sheet adapted to protect adjacent surfaces and to hold said liner in said keyway.

9. The invention according to claim 6 in which:

said keyway has an extension in said driven flap to provide a continuous recess from the keyway to the opening to receive the pin;

said liner having a configuration to fit in said continuous recess so as to receive said key and said pin;

said outer peripheral edge of said liner extending around said pin in contact with said retainer means.

10. The invention according to claim 1 in which:

said retainer means secures said liner in association with said key and keyway by being held in abutment with said flaps and in abutment with said liner by said flaps and said key and keyway.

11. The invention according to claim 1 in which:

said retainer means is self-aligning between said flaps, being adapted to seat on a portion of said key.

12. In a fluid foil having a plurality of trailing control flaps, or the like, hingedly engaged to the foil for rotation with respect thereto, at least one of said flaps being a driving flap and at least one of said flaps being a driven flap, a key extending from said driving flap into a keyway in said driven flap so that said flaps rotate together with respect to said foil, an elastic member being fitted into said keyway and being fitted on said key to protect surfaces of said key and keyway, the improvement comprising:

sealing means between said driving and driven flaps in association with said key and keyway and joined with said elastic member to retain the elastic member in the keyway and on the key.

13. The invention according to claim 12 in which:
said sealing means extend from a sealing contact with a foil trailing surface to adjacent the trailing edge of said flaps.

14. In a fluid foil having a plurality of trailing control flaps, or the like, hingedly engaged to the foil for rotation with respect thereto,
at least one of said flaps being a driving flap and at least one of said flaps being a driven flap,
a key extending from said driving flap into a keyway in said driven flap so that said flaps rotate together with respect to said foil,
an elastic liner being fitted into said keyway and being fitted on said key to protect surfaces of the key and keyway,
the improvement comprising:
retainer means between said driving and driven flaps in association with said key and keyway to secure said liner in said association with said key and keyway;
said liner extending outwardly to and along the periphery of the keyway opening so as to contact said retainer means;
said driving flap having a face transverse to said key and in contact with said retainer means;
said retainer means having an opening through which said key extends;
said driven flap having a face transverse to said keyway and opposing said transverse face of said driving flap; and
an outer peripheral edge of said liner extending along the transverse face of said driven flap;
said retainer means being in substantial sealing contact with said opposing transverse faces on said flaps and on said peripheral edge of said liner.

15. The invention according to claim 14 in which:
said foil has a trailing concave surface adjacent which leading surfaces of said flaps are adapted to rotate;
said retainer means making contact with said concave surface to form a seal thereon in the directions of said transverse faces.

16. The invention according to claim 14 including:
a hinge pin extending through openings in said opposing transverse faces in the general direction of said key; and
said retainer means having an opening through which said hinge pin extends.

17. The invention according to claim 16 in which:
said retainer means is self-aligning between said transverse faces on said key, and said hinge pin.

18. The invention according to claim 17 in which:
said retainer means is an elastic sheet adapted to protect adjacent surfaces and to hold said liner in said keyway.

19. The invention according to claim 16 in which:
said keyway has an extension in said driven flap to provide a continuous recess from the keyway to the opening to receive the pin;
said liner having a configuration to fit in said continuous recess so as to receive said key and said pin;
said outer peripheral edge of said liner extending around said pin in contact with said retainer means.

20. The invention according to claim 14 in which:
said retainer means secures said liner in association with said key and keyway by being held in abutment with said flaps and in abutment with said liner by said flaps and said key and keyway.

* * * * *